US005232460A

United States Patent [19]

Botz

[11] Patent Number: 5,232,460

[45] Date of Patent: Aug. 3, 1993

[54] SYSTEM AND PROCESS FOR RECYCLING AQUEOUS CLEANERS

[75] Inventor: Frank K. Botz, Waltham, Mass.

[73] Assignee: W. R. Grace & Co.-Conn., New York, N.Y.

[21] Appl. No.: 729,131

[22] Filed: Jul. 12, 1991

[51] Int. Cl.[5] ..... D06F 95/00

[52] U.S. Cl. ..... 8/141; 8/137; 210/702; 210/712; 210/723; 210/724; 210/167; 252/158; 252/153; 134/13; 134/41

[58] Field of Search ..... 8/141, 137; 210/702, 210/724, 723, 712, 167; 252/158, 153; 134/13, 41

[56] References Cited

U.S. PATENT DOCUMENTS

| | | | |
|---|---|---|---|
| 3,830,789 | 8/1974 | Garrett et al. | 260/97.6 |
| 3,886,099 | 5/1975 | Hall | 252/548 |
| 4,100,181 | 7/1978 | Phillips et al. | 260/416 |
| 4,118,407 | 10/1978 | Red et al. | 260/412.5 |
| 4,330,342 | 5/1982 | Fennemann et al. | 134/13 |
| 4,481,236 | 11/1984 | Forsterling | 427/97 |
| 4,788,043 | 11/1988 | Kagiyama et al. | 422/292 |
| 4,897,203 | 1/1990 | King | 210/754 |
| 4,986,462 | 1/1991 | Hethcoat | 228/180.1 |

*Primary Examiner*—Ellen M. McAvoy

*Attorney, Agent, or Firm*—John Dana Hubbard; William L. Baker

[57] ABSTRACT

A system and process for recycling alkaline aqueous cleaners for electronic components. Such cleaners generally contain saponifiers which react with rosin flux on the electronic components to form rosin soaps. Spent cleaner is concentrated, the pH is lowered to cause a separation between the cleaner and the soils within the cleaner. The cleaner then is filtered to further remove any soils. The filtered cleaner is then reconstituted to a determined concentration and pH level and returned to the cleaning system.

20 Claims, 1 Drawing Sheet

SYSTEM AND PROCESS FOR RECYCLING AQUEOUS CLEANERS

This invention relates to a system and a process for recycling water based cleaning compounds. More particularly, it relates to a system and a process of recycling alkaline aqueous cleaners used for cleaning electronic products such as printed wire assemblies.

BACKGROUND OF THE INVENTION

Printed wire assemblies (PWA) are formed of electronic components soldered to a circuit board. They and other such electronic components need to be cleaned after manufacture to remove various contaminants such as solder flux, solder balls and other such soils. Failure to remove these soils can cause dielectric breakdown of the components, corrosion, poor conformal coat adhesion and poor electrical contact as well as being cosmetically unacceptable.

Traditionally, chlorofluorocarbons (CFCs) have been used to remove these soils. However, the use of CFCs has come under increased restrictions due to their propensity to destroy the ozone layer and contribute to global warming.

Other solvent based or semi-aqueous cleaners have been proposed and used. While they provide adequate cleaning, they also have come under additional scrutinty. For example, some solvents are believed to cause various health problems. Additionally, many are also believed to contribute to global warming. Lastly, the waste stream generated by these systems is difficult to dispose of, often requiring incineration.

Alkaline aqueous based cleaners are becoming the preferred cleaners. These materials contain no CFCs or solvents and therefore are relatively safety to use. Moreover, due to the large amount of water used with such systems and thereby corresponding small amounts of chemicals, the standard practice has been to use the cleaner once and dispose of the soiled cleaner in a waste treatment process.

The expense of waste treatment and of the cleaner itself as well as the restrictions on water usage that have been imposed in various portions of the United States has developed a need for a process by which the cleaner and water can recycled.

The present invention provides a system and a process for recycling alkaline aqueous cleaners which reduces the consumption of cleaner and water and which reduces the need for and cost of waste treatment.

SUMMARY OF THE INVENTION

The present invention is a system and a process for recycling alkaline aqueous cleaners by removing soiled cleaner to a holding area where the pH of the cleaner is dropped to a level sufficient to allow the cleaner to separate out its contaminants. The cleaner is filtered and the filtrate is reconstituted with additional cleaner and water and the pH is raised to a level sufficient to obtain adequate cleaning and returned to the cleaning area for reuse.

IN THE DRAWING

DETAILED DESCRIPTION OF THE INVENTION

Figure 1:
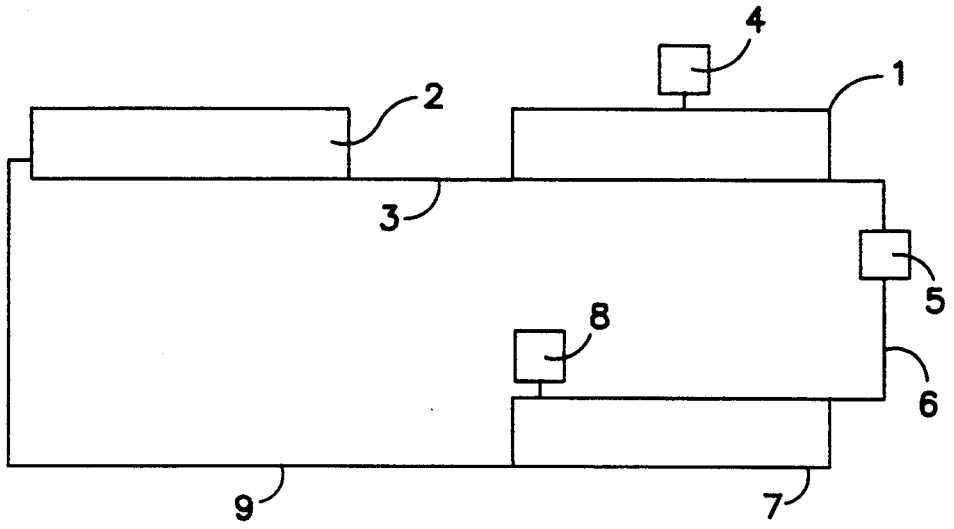
FIG. 1 shows a diagram of a system according to one embodiment of the present invention.

Alkaline aqueous cleaners generally contain a number of typical components which are varied to provide properties necessary or specific for the desired application. This will include surfactants to provide detergency, wetting, coupling, defoaming, dispersing or emulsifying properties. It will include builders to provide saponification, buffering and alkaline reserve. It will include corrosion inhibitors when necessary. It will include complexing or chelating agents to remove detrimental contaminants.

Alkaline aqueous cleaners designed to remove fluxes and other soils from a printed wire assembly generally include a combination of saponifiers, coupling agents, wetting agents, complexing agents and corrosion inhibitors. The saponifiers are generally alkanol amines as MEA, DEA, TEA, etc. The coupling agents are frequently glycol ethers such as butyl carbitol, butoxypropanol, etc. The wetting agents are typically non-ionics such as alkanol ethoxylates, aryl ethoxylates, and possibly fluorinated derivations of the same.

The corrosion inhibitors are blends of carboxylic acids, amides and amines. The complexing agents are commonly EDTA, NTA, etc. In addition, builders may be added to provide alkalinity and buffering reserve. These may be a caustic as KOH or NaOH.

Such cleaners are well-known, for example from U.S. Pat. No. 3,886,099, which is incorporated herein by reference.

The cleaner primarily is designed to remove rosin flux which is left over from the manufacturing process. The saponifier preferably an amine converts the insoluble rosin acid and rosin salts of the flux into a water soluble soap. The rate of this conversion is dependent upon the concentration of the saponifier, the pH and the temperature.

The coupling agents, wetting agents and complexing agents reduce cleaning time. It is believed that they improve wetting and the ability of the saponifier to reach and react with the rosin and other soils. Additionally they help to remove or drain the formed soap and other soils such as solder balls, dust, processing oils, etc. from the surface.

The addition of a caustic also increases the rate of cleaning by maintaining the pH at a desirable level.

By balancing these constituents, the operational pH, and the temperature, one can achieve acceptable cleaning performance. The pH of such a cleaning system is preferably 10 or greater, more preferably between 10 and 12 and most preferably about 11.5. The temperature is generally at or above room temperature, preferably 50° to 70° C.

The aqueous cleaner generally contains 5–15% cleaner (saponifier, caustic and other constituents), the remainder being water. It is used in a bath or spray into which or through which the component is carried.

After cleaning, the electronic component is rinsed with water to ensure that no residual cleaner or soil remains or redeposits itself on the component as it dries.

After a given amount of dwell time in the cleaning zone, the cleaner becomes less effective as it now is carrying removed soils. Additionally, due to the formation of the soap, the effective amount of saponifier (amine) is substantially reduced, thus causing a reduction in the ability of the cleaner to perform its function. Moreover, some cleaner is carried to the rinse area (drag off) and lost from the system, thereby further reducing cleaning efficiency.

One preferred embodiment of the present invention is shown in FIG. 1. A holding area 1 is connected to the cleaning area 2 be a connection means 3. Contaminated cleaning fluid is drawn off from the cleaning area 2 to the holding area 1 where a means for reducing the pH of the cleaner 4 introduces a pH reducing agent in an amount sufficient to cause the water soluble soap to disassociate into the saponifier and the rosin acid and/or rosin salts. The rosin component as well as other soils, such as solder, dust, dirt and oil are allowed to settle out so as to form two phases, one liquid, containing substantially pure cleaner and water, the other, a viscous or fluid substantial solid, containing substantially waste material with minor amounts of cleaner and/or water. The liquid phase is then passed through a filter 5 to ensure that any remaining organic and particulate matter is removed. After filtration, the cleaner is passed via a connection means 6 to a make up area 7 where it is readjusted with the addition of cleaner concentrate and/or water and sufficient alkaline material through a cleaner reconstitution device 8 so that the cleaner is at the desired concentration and pH for effective cleaning. After readjustment, the cleaner is transferred back to cleaning area 2 for use via a third connection means 9.

The system may be separate from the cleaning equipment as shown in FIG. 1 or if desired may be incorporated into or adjacent to the cleaning equipment.

The holding area 1 may be a separate tank, open or closed, which may be made of any acceptable material such as stainless steel, enamel coated steel, plastic, fiberglass, etc. It should be of a size sufficient to allow for the treatment of an adequate amount of the fluid. Alternatively, the holding area 1 may be formed from a portion of the cleaning area 2. In this alternative, the portion of the cleaning area 2 should again be sufficient so as to allow for adequate treatment. Preferably, it is portion of a tank in which the cleaning takes place. More preferably, it consists of a quiet area such as may be formed by the use of a dam to separate one portion of the cleaning area 2 from the other.

The connection means 3, 6 and 9 may be a pipe, tube, conduit, trough or other well-known means for conveying a fluid from one place to another and may be formed of metal, such as stainless steel or plastic such as polyethylene, polypropylene PTFE resin, etc.

The means for reducing the pH, 4, and the means for reconstituting the cleaner may be any well-known metering device for the dispensing of liquids or solids. The pH reducing agent may be an acid, an acid salt and any other well-known, pH reducing agent. Likewise, the pH raising agent may be any caustic or other well-known pH increasing agent. The cleaner reconstitution material may be cleaner concentrate, or individual components of the cleaner, especially the saponifier. The amount dispensed can be easily determined by the amount of fluid in the holding area, the concentration of the cleaner and the operational pH. Alternatively, one may incorporate an electronic measuring device, such as a pH meter, etc. which will automatically determine and dispense the required constituents in the correct amount.

The filter may be any filter which is commonly used to filter fluids, such as basket filters, centrifigal filters, pleated fabric filters, etc. The filter does not need to be microporous as most of the contaminants are removed from the liquid phase by the reduction in pH. Three general categories of filters, based on the size op the particles to be filtered are typically used. The smallest, ultrafine, removes particles of 1 micron in size or larger. The next largest, fine particle filter, removes particles of 10 microns or larger. The last, coarse filtration, removes particles of 50 microns or larger. Preferably, one should use a filter having a filtering capability of less than 50 microns as the removal of soils only greater than 50 microns will not remove effective amounts of soil from the cleaner. More preferably a combination of fillers is used. Preferably when a series of filters is used, filtering out of largest particles occurs first and progresses to smaller sizes sequentially. More preferably, one will use a filter or filters that will remove particles of 10 microns or larger. However, if desired, one may filter the cleaner to remove even ultra-fine particles, although in practice it has been found that such filtration is generally not needed.

The make up area may be a tank such as described above in regard to the holding area 1, or it may be any other means which would allow for the reconstitution of the fluid. It is preferred that the make up area be a tank or a portion of the cleaning area that is separate from the cleaning area and the holding area so that reconstitution can take place without any adverse effects to it, the removed contaminents, etc.

In order to cause the fluid to move to the various areas in the system, one may use a pump or pumps or other such well-known means for moving the fluid through the system. Suitable pumps are well-known and may include, diaphragm type pumps, piston pumps, progressive cavity pumps, lobe pumps, etc. Alternatively, one may use the pump of the cleaning equipment to move the fluid.

An other embodiment which may be used is based upon the fact that most of the contaminents are in the form of a soap. In this embodiment, one may collect the soap which floats upon the surface in a holding area 1 and remove it, either by skimming or by mopping it off, leaving mostly cleaning fluid, some soap and some particulate waste. The remaining fluid may then be treated in the manner described before. This embodiment allows for easy removal of most of the soils before separation. If desired the removed soap can be separately treated to recover the saponifier.

Figure 2:
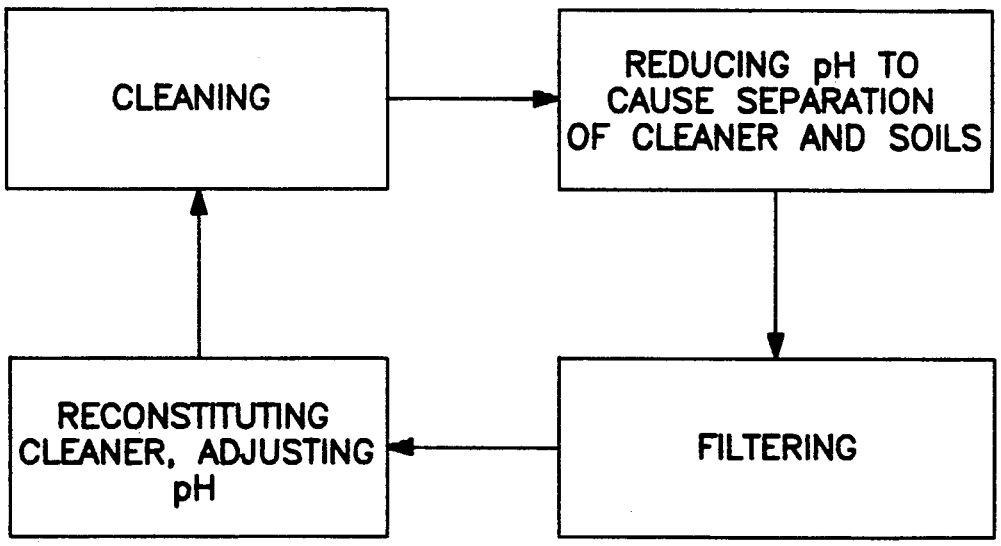
FIG. 2 shows a block diagram of a process according to one preferred embodiment of the present inventions.

The process used in the present invention as shown in the block diagram of FIG. 2 consists of withdrawing an amount of soiled cleaner to a holding area 1, where if desired the soap is skimmed from the cleaner. Thereafter, an amount of pH reducing agent is added to the cleaner so as to reduce the pH of the cleaner and disassociate the rosin flux constituent from the cleaner, thus forming two phases, one, a liquid consisting essentially of cleaner, and the other, a viscous fluid and/or solid containing essentially rosin flux, and other contaminants. The pH is generally reduced below 10, preferably below 8, more preferably below 7 to ensure a complete separation and conversion of the soap into rosin and saponifier. The cleaner is then passed through a filter to remove any remaining soils. The filtered concentrate is then reconstituted to make up for lost saponifiers, wetting and other agents, caustics, etc. and the pH is then raised, generally through the introduction of a caustic, to result in the preparation of the cleaner for reuse in the cleaning area 2. If desired, a portion of or the entire process may be heated to provide better results and to provide a refreshed cleaner that is ready for use.

The recycling process may occur in a batch type of process or a continuous process. In the batch process one would need a sufficient amount of fluid such that while one fluid is being used in the cleaning area, the other portion of the fluid is being recycled. Typically, this would involve two sumps of fluid, generally of equal volume. However, if process conditions (length of time required to recycle, length of time after which cleaning activity drops below a desired level, etc.) are such that additional supplies of fluid are needed, then more than two sumps or supplies of fluid greater than twice the volume in the cleaning process may be used.

Alternatively, small amounts of fluid can be continuously drawn off from the cleaning area, recycled and returned to the cleaning area. In this continuous use embodiment, the amount of cleaner in the cleaning area should be sufficient so that the amount of cleaner that is being recycled at any given time does not adversely affect the cleaning process.

The above described apparatus and process allow for the removal of a substantial amount of contaminents from the cleaner with essentially a complete recovery of the cleaner. Waste disposal of the contaminents and soiled filters is easier as it is highly concentrated and contains little, if any, water. Moreover, as little cleaner or contaminents are carried downstream in the process, waste water treatment is easier in that there are less materials to be treated.

The present invention provides a simple, practical alternative to the present one time usage of aqueous cleaners and provides a saving in the cost of cleaner, water and waste treatment.

While the present invention is described in relation to its preferred embodiments, other embodiments, variations and equivalents will be obvious to one of ordinary skill on the art and it is intended in the appended claims to include all such embodiments, variations and equivalents thereto.

What is claimed is:

1. A system for recycling soiled aqueous alkaline cleaners comprising a soiled cleaning fluid formed of a saponifier, a surfactant and a caustic, a means for moving the cleaning fluid from a cleaning means to a holding means, a means for reducing pH of the cleaning fluid so as to create two phases, a first phase consisting essentially of cleaning fluid and a second phase consisting essentially of rosin flux and other contaminants, a means for filtering the first phase so as to remove any residual contaminants, a means connecting the filtering means to a make up means for removing the cleaning fluid from the filtering means to the make up means, the make up means containing a means for replenishing lost constituents of the cleaner fluid and a means for returning the cleaner fluid to the cleaning means, the returning means being connected between the make up means and the cleaning means.

2. The system of claim 1 wherein the cleaning means is a bath or a spray, the holding means is a tank, the means for causing the precipitation of contaminants is a pH reducing agent dispenser, the means for filtering is a filter, the means connecting the filtering means to the make up area is selected from the group consisting of pipes, tubes, conduits and troughs, the make up means is a tank, the means for replenishing is a dispenser for cleanser constituents and pH raising agents and the returning means is selected from the group consisting of pipes, tubes, conduits and troughs.

3. The system of claim 1 further comprising one or more pumping means for moving the cleaning fluid through the system and a means for heating the cleaning fluid in the system.

4. The system of claim 3 wherein the pumping means is a pump and the heating means is a heater.

5. The system of claim 1 wherein the holding means forms a portion of the cleaning means.

6. A system for recycling soiled aqueous alkaline saponifier cleaners comprising a cleaning area, a holding area, a first conduit between the cleaning area and the holding area for transporting the cleaner fluid from the cleaning area to the holding area, a pH reducing agent dispenser connected to the holding area, a filter located at an outlet from the holding area, a second conduit connecting the filter to a make up area, the make up area having a pH raising agent dispenser and a cleaner constituent dispenser and a third conduit connecting an outlet of the make up area to the cleaning area.

7. The system of claim 6 wherein the cleaning area is a bath or spray; the holding area and the make up area are tanks; the first, second and third conduits are selected from the group consisting of pipes, tubes, conduits and troughs and the filter is selected from the group consisting of basket, pleated fabric and centrifugal filters.

8. The system according to claim 6 further comprising one or more pumping means for circulating cleaning fluid through the system, and a heating means for heating cleaning fluid in the system.

9. A recycling system for soiled aqueous alkaline cleaners comprising an inlet means for connecting the system to a supply of cleaner, a holding means for retaining the cleaner, a means for reducing the pH of the cleaner so as to cause the disassociation of soils and contaminants from the cleaner, a filtering means for removing additional soils and contaminents from the cleaner, an outlet from the holding area, a connection means connecting the outlet to a make up means, the make up means having a means for raising the pH of the cleaner and for adding additional cleaner constituents, a second outlet means attached to the make up means, a second connection means for connecting the second outlet to an inlet of the supply of cleaner.

10. The system of claim 9 further comprising a means for removing soil or contaminants from a surface of the cleaning fluid in the holding means.

11. A process for recycling aqueous alkaline cleaning fluid comprising the steps of:

a.) withdrawing soiled cleaning fluid from a supply of such fluid to a holding area;

b.) reducing the pH of the cleaning fluid in the holding area so as to cause disassociation of soils from the cleaning fluid;

c.) filtering the cleaning fluid;

d.) adding additional cleaner constituents to reach a desired level of concentration;

e.) raising the pH of the cleaner to a desired level and returning it to the supply.

12. The process of claim 11 further comprising a step between steps (a) and (b) of removing any contaminants that may accumulate on a surface of the cleaning fluid in the holding area.

13. The process of claim 11 further comprising the step of heating the cleaning fluid in the system.

14. The process of claim 11 wherein the pH is reduced to a level of below 10.

15. The process of claim 11 wherein the pH is reduced to a level of below 8.

16. A process for recycling aqueous alkaline cleaning fluids comprising the steps of:

a.) withdrawing soiled cleaning fluid from a cleaning system to a holding area;

b.) removing any soil or contamination that is present on a surface of the cleaning fluid;

c.) reducing the pH of the cleaning fluid to cause a separation between the cleaning fluid and any contaminants, d.) removing the cleaning fluid and filtering such fluid;

e.) reconstituting the cleaning fluid to a desired concentration and pH level; and f.) returning the cleaning fluid to the cleaning system.

17. The process of claim 16 wherein the PH is reduced to a level below 10, preferably below 8.

18. The process of claim 16 where the pH is reduced to a level of below 7.

19. The process of claim 16 wherein the soil or contaminants on the surface of the cleaning fluid is removed by skimming or mopping the surface.

20. The process of claim 16 wherein the fluid is reconstituted by the addition of cleaner constituents and pH raising agents.

* * * * *